United States Patent [19]

Horgan

[11] Patent Number: 5,018,897

[45] Date of Patent: May 28, 1991

[54] CARD FILE ADAPTOR

[76] Inventor: Gary A. Horgan, 214 Newton St., Waltham, Mass. 02154

[21] Appl. No.: 492,942

[22] Filed: Mar. 13, 1990

[51] Int. Cl.[5] ..... B42D 15/00; B42F 19/04

[52] U.S. Cl. ..... 402/79; 40/360

[58] Field of Search ..... 402/79; 40/359, 360

[56] References Cited

U.S. PATENT DOCUMENTS

| | | | |
|---|---|---|---|
| 4,643,452 | 2/1987 | Chang | 283/62 |
| 4,713,901 | 12/1987 | Wells et al. | 402/79 X |
| 4,849,056 | 7/1989 | Ristuccia, Sr. | 402/79 |
| 4,917,523 | 4/1990 | Merrick et al. | 402/79 |

OTHER PUBLICATIONS

Sample of card file mounting member provided by Merrick Industries, purportedly in public domain circa 1984 (unverified) (attached herebelow).

*Primary Examiner*—Paul A. Bell

*Attorney, Agent, or Firm*—Weingarten, Schurgin, Gagnebin & Hayes

[57] ABSTRACT

A card file adaptor is described that permits non-destructive mounting of business cards and the like in conventional card files. The adaptor has predetermined openings formed in the bottom edge thereof so that the adaptor may be inserted or removed from standard card files. The adaptor includes an adhesive layer along the upper edge thereof for adhering a business card thereto. Leveling tabs and/or leveling notches are formed in the card file adaptor to provide physical structures for aligning the business card with respect to the card file adaptor for adherence thereto.

5 Claims, 2 Drawing Sheets

CARD FILE ADAPTOR

RELATED INFORMATION

The present invention has been described in Disclosure Document Numbers 228,084 and 231,552 filed in the United States Patent and Trademark Office.

FIELD OF THE INVENTION

The present invention relates to card filing systems, and more particularly to a card file adaptor that facilitates non-destructive mounting of business cards and the like into conventional card files such as rolling indexes and other card filing systems.

BACKGROUND OF THE INVENTION

Card files are well know means for storing information so that it is readily accessible. Conventional card files typically include a storage container, guide rails within the storage container, and specially configured cards that may be readily inserted and removed from the guide rails. The inserted cards are readily movable along the guide rails to provide easy access to specific cards having desired information.

One major disadvantage of conventional card files is that information must be transposed to the cards. Transposition of such information to the cards is a labor intensive operation. In addition, the special configuration of the cards presents difficulties in transposing information to the cards by means of a typewriter. Therefore, a need exists for some means for incorporating standardized index cards and business cards in combination with conventional card files.

Preferably, such means should be simple to implement and not involve the partial destruction of the index or business card. Simply punching holes in standardized index cards or business cards may result in obliteration of useful information and/or a significant reduction in the useful area of the card available for information storage.

One such means is illustrated in U.S. Pat. No. 4,643,452. The business card attaching strip of the '452 patent includes two specially punched holes for mounting the strip in conventional card files. The strip includes an adhesive coating for mounting standardized index and business cards thereto in a non-destructive manner. The attaching strip of the '452 patent, however, is inherently disadvantageous in that no physical means are provided for aligning the card for adherence to the adhesive coating.

The '452 patent teaches the use of a line to assist in aligning the card with respect to the attaching strip. This method of aligning the card for adherence to the attaching strip requires a certain degree of eye-hand coordination to align the card with respective to the adhesive coating which is certainly inconvenient.

SUMMARY OF THE INVENTION

The card file adaptor of the present invention provides a means for non-destructive mounting of index and business cards in conventional card files. In addition, the card file adaptor provides physical structure that facilitates aligning of cards for adherence to the adaptor.

The card file adaptor of the present invention includes predetermined openings formed in the bottom edge thereof so that the adaptor may be inserted or removed from standard card files. The adaptor includes an adhesive layer along the upper edge thereof for adhering a business card thereto. Leveling tabs and/or leveling notches are formed in the card file adaptor to provide physical structures for aligning the business card with respect to the card file adaptor for adherence thereto.

DESCRIPTION OF PREFERRED EMBODIMENTS

Figure 1A:
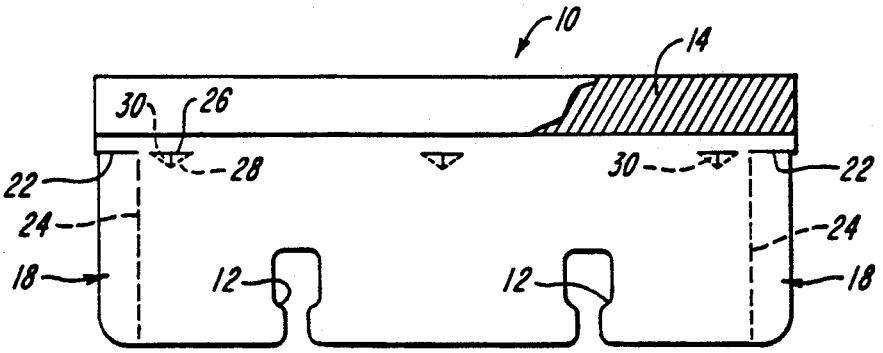
FIG. 1A is a plan view of an card file adaptor, partially cut away, according to the present invention.
Figure 1B:
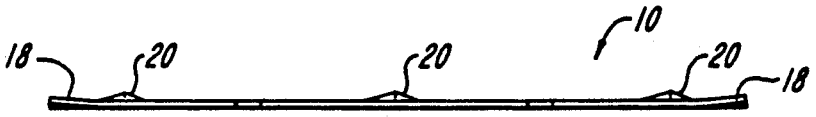
FIG. 1B is a bottom-edge view of the card file adaptor of FIG. 1A.
Figure 1C:
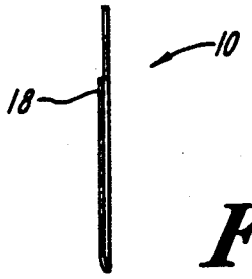
FIG. 1C is an side-edge view of the card file adaptor of FIG. 1A.

Referring to the drawings wherein like reference numerals designate corresponding or similar elements throughout the several views, FIGS. 1A, 1B, 1C illustrate an exemplary embodiment of a card file adaptor 10 according to the present invention. While the card file adaptor 10 is discussed as having utility for mounting business cards in standard card files, it is to be understood that the card file adaptor 10 may be used to mount other types of cards, e.g., recipe cards, note cards, in standard card files.

The card file adaptor 10 has a generally rectangular shape and is formed from stiff paper, plastic or the like. The adaptor 10 may be transparent or opaque. The card file adaptor 10 includes two spaced-apart specially punched openings 12 along the bottom edge thereof, a layer of adhesive 14 along the upper edge thereof, a protective strip 16 covering the adhesive layer 14, leveling tabs 18 formed in opposed side edges, and one or more leveling notches 20.

The two spaced-apart punched openings 12 are configured to permit the card file adaptor 10 to be easily inserted and removed from standard card files. It is to be understood that the number and positioning of the openings 12 may be varied to accommodate card files of different configurations.

The leveling tabs 18 are formed in the adaptor 10 by cut lines 22 extending inwardly from opposed side edges of the adaptor 10. Bend lines 24 extend from the inner end of the cut lines 22 to the bottom edge of the adaptor 10. The leveling tabs 18 are bent out of the plane of the adaptor 10 so as to extend outwardly from the face of the adaptor 10 containing the adhesive layer 14.

The leveling notches 20 are formed in the adaptor by cut lines 26 formed in the adaptor 10 that are generally collinear with the cut lines 22 of the leveling tabs 18. Bend lines 28 are formed from the ends of each cut line 26 to an apex and another bend line 30 extends from the apex to approximately the midpoint of the respective cut line 26. The leveling notches 20 are bent out of the plane of the adaptor 10 so as to extend outwardly from the face of the adaptor 10 containing the adhesive layer 14.

The leveling tabs 18 and the leveling notches 20 provide a physical means for aligning a business card for adherence to the adaptor 10. The lower edge of the business card engages the cut edges 22, 26 of the leveling tabs 18 and the leveling notches 20, respectively, and is thereby physically positioned adjacent the adhesive layer 14. While the card file adaptor 10 has been shown with both leveling tabs 18 and leveling notches 20, it will be appreciated that either the leveling tabs 18 or the leveling notches 20 may be used to physically align the business card for mounting to the adhesive layer 14.

Figure 2:
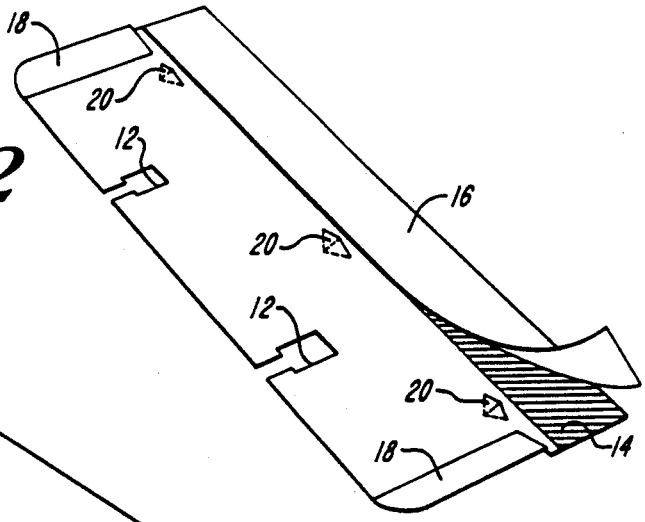
FIG. 2 is a perspective view of the card file adaptor of FIG. 1A with the protective strip partially removed.
Figure 3:
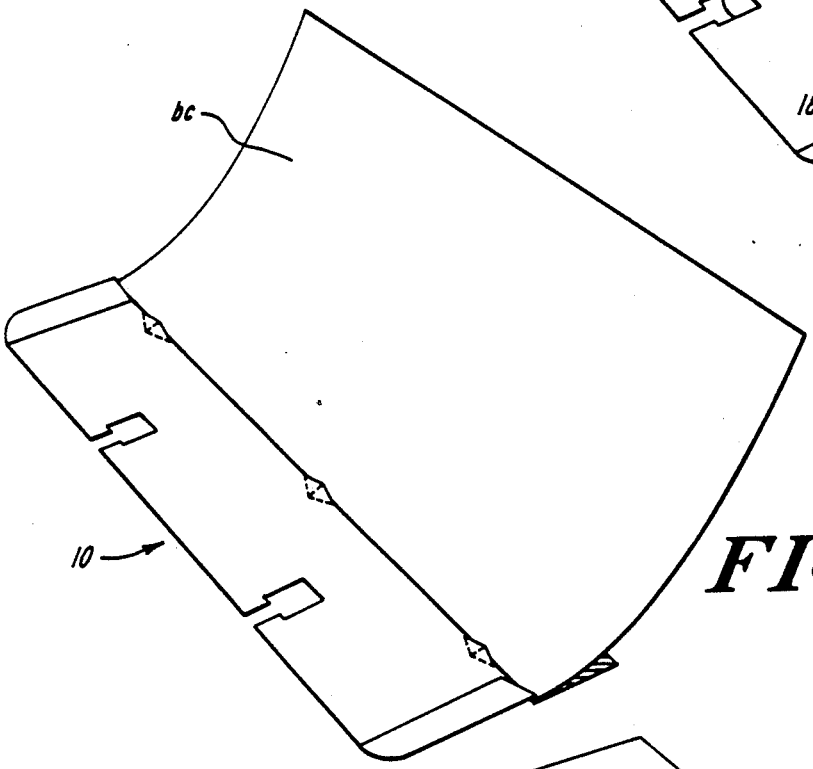
FIG. 3 illustrates the procedure for aligning a business card in combination with the card file adaptor of the present invention.

FIGS. 2 and 3 illustrate the procedure for mounting a business card in combination with the file card adaptor 10 of the present invention. First the protective strip 16 is removed to expose the adhesive layer 14. Next, the business card bc is inserted at an angle to physically engage the cut edges 22, 26 of the leveling tabs 18 and leveling notches 22, respectively. By inserting the business card bc at an angle, the card bc may be aligned for mounting without engaging the adhesive layer 14. After the business card has been physically engaged against the leveling tabs 18 and the leveling notches 22, the business card bc is pressed downwardly onto the adhesive layer 14 and adhered thereto.

Figure 4:
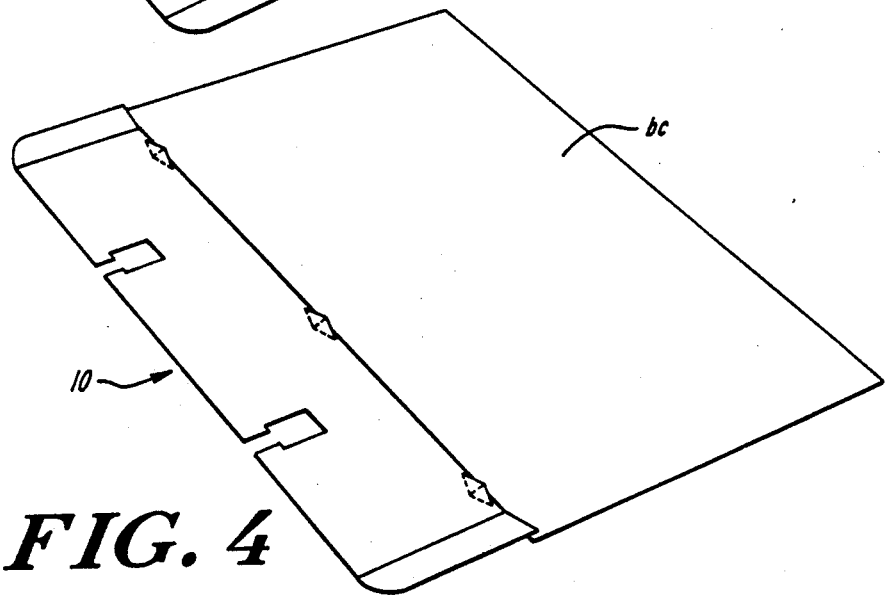
FIG. 4 depicts a business card adhered in combination with the card file adaptor of the present invention.

The business card bc mounted in combination with the file card adaptor 10 is illustrated in FIG. 4. The adhesive layer 14 is adhered to the back of the business card bc so that the front of the business card is unobstructed. The leveling tabs 18 and the leveling notches 20 may be bent back into the plane of the adaptor 10 if desired to facilitate insertion of the adaptor 10 into a standard card file by means of the openings 12. Alternatively, the leveling tabs 18 may be separated from the adaptor 10 to facilitate insertion of the adaptor 10 into a standard card file.

A variety of modifications and variations of the present invention are possible in light of the above teachings. It is therefore to be understood that within the scope of the appended claims, the present invention may be practiced otherwise than as specifically described hereinabove.

What is claimed is:

1. A card file adaptor for non-destructive mounting of a card in a conventional card file, comprising:

a strip of material sized to fit in the conventional card file, said material strip having at least one predetermined opening formed in a first edge thereof for mounting said material strip in the conventional card file;

an adhesive layer formed on the face of said material strip along a second edge thereof;

a removable protective strip covering said adhesive layer; and means formed in said material strip and extending outwardly from the face of said strip containing the adhesive layer for physically engaging a bottom edge of the card to support the card in alignment superjacent said adhesive layer wherein the card may be adhered to said card file adaptor by pressing the card into engagement with said adhesive layer while the bottom edge is supported by the physical engaging means.

2. The card file adaptor of claim 1 wherein said physical engaging means comprises leveling tabs formed in opposed edges of said material strip, said leveling tabs being formed by making cut lines approximately parallel to said adhesive layer and bend lines approximately perpendicular to the internal ends of said cut lines and bending said leveling tabs to depend outwardly of the face of said material sheet containing said adhesive layer wherein said cut lines of said leveling tabs will physically engage the bottom edge of the card to align the card superjacent said adhesive layer wherein the card may be adhered to said card file adaptor by pressing the card into engagement with said adhesive layer.

3. The card file adaptor of claim 1 wherein said physical engaging means comprises at least one leveling notch formed in said material strip, said at least one leveling notch being formed by making a cut line approximately parallel to said adhesive layer and intersecting bend lines extending from ends of said cut line and bending said at least one leveling notch to depend outwardly of the face of said material sheet containing said adhesive layer wherein said cut line of said at least one leveling notch will physically engage the bottom edge of the card to align the card superjacent said adhesive layer wherein the card may be adhered to said card file adaptor by pressing the card into engagement with said adhesive layer.

4. The card file adaptor of claim 3 wherein said physical engaging means comprises at least two spaced-apart leveling notches formed in said material strip, said leveling notches being formed by making respective spaced-apart cut lines approximately parallel to said adhesive layer and respective intersecting bend lines extending from ends of said spaced-apart cut lines and bending said spaced-apart leveling notches to depend outwardly of the face of said material sheet containing said adhesive layer wherein said cut lines of said spaced-apart leveling notches will physically engage the bottom edge of the card to align the card superjacent said adhesive layer wherein the card may be adhered to said card file adaptor by pressing the card into engagement with said adhesive layer.

5. The card file adaptor of claim 1 wherein said physical engaging means comprises:

leveling tabs formed in opposed edges of said material strip, said leveling tabs being formed by making cut lines approximately parallel to said adhesive layer and bend lines approximately perpendicular to the internal ends of said cut lines and bending said leveling tabs to depend outwardly of the face of said material sheet containing said adhesive layer; and at least one leveling notch formed in said material strip, said at least one leveling notch being formed by making a cut line approximately parallel to said adhesive layer and colinear with said cut lines of said leveling tabs and intersecting bend lines extending from ends of said cut line and bending said at least one leveling notch to depend outwardly of the face of said material sheet containing said adhesive layer;

wherein said cut lines of said leveling tabs and said at least one leveling notch will physically engage the bottom edge of the card to align the card superjacent said adhesive layer wherein the card may be adhered to said card file adaptor by pressing the card into engagement with said adhesive layer.

* * * * *